United States Patent [19]

Vijayendran

[11] 3,980,576

[45] Sept. 14, 1976

[54] SOLID TONER COMPOSITIONS AS USED IN DEVELOPMENT POWDERS

[75] Inventor: Bheema Rao Vijayendran, Bethel, Conn.

[73] Assignee: Pitney-Bowes, Inc., Stamford, Conn.

[22] Filed: Jan. 10, 1975

[21] Appl. No.: 540,130

[52] U.S. Cl. ..... 252/62.1 P; 96/1 SD; 427/18

[51] Int. Cl.[2] ..... G03G 9/00

[58] Field of Search ..... 252/62.1; 427/14, 18, 427/20; 96/1 SD

[56] References Cited

UNITED STATES PATENTS

| | | | |
|---|---|---|---|
| 2,892,794 | 6/1959 | Insalaco | 252/62.1 |
| 3,079,342 | 2/1963 | Insalaco | 252/62.1 P |
| 3,090,755 | 5/1963 | Erchak | 252/62.1 P |
| 3,391,082 | 7/1968 | Maclay | 252/62.1 P |
| 3,609,082 | 9/1971 | Moriconi et al. | 252/62.1 P |
| 3,844,815 | 10/1974 | Parent et al. | 252/62.1 P |

*Primary Examiner*—John D. Welsh

*Attorney, Agent, or Firm*—Peter Vrahotes; William D. Soltow, Jr.; Albert W. Scribner

[57] ABSTRACT

Developer powders are disclosed which use a resinous binder comprising a combination of thermoplastic resins based on a copolymer comprising a styrene and an acrylate or methacrylate selected from the group including butyl, isobutyl, ethyl, propyl and isopropyl, which copolymer is combined with vinyltoluene-butadiene. These developer powders have a melt index of 20 to 30, a melting point of 75°–100°C and a dielectric constant of 4 to 5.

18 Claims, No Drawings

SOLID TONER COMPOSITIONS AS USED IN DEVELOPMENT POWDERS

BACKGROUND OF THE INVENTION

This invention relates to electroscopic solid toners that are useful as a binder in development powders for developing a latent electrostatic image produced by photoelectrostatic copy techniques. More particularly, it relates to electroscopic solid toners which are formulated with thermoplastic resins based on acrylics.

Electrostatic copying process are well known in which a photoconductive medium is charged by exposure to light passing through an original to produce an electrostatic charge which may be developed with an electroscopic development powder. A wide variety of photoconductive media may be employed, such as inorganic photoconductive materials, organic photoconductors and elemental photoconductors.

A wide variety of techniques are known for developing the charged photoconductive medium such as magnetic brush, powder cloud, liquid developers and cascading techniques.

The formulation of electroscopic development powders that are compatible in a particular photoelectrostatic copying environment has been widely sought in this art and is well developed. Most commercially available electroscopic development powders consist of two or more thermoplastic resins whose combination have the right triboelectric charge as well as a sufficiently low softening point for proper fusing. Difficulty has been encountered however, since the use of different types of resins in solid toners lead to some undesirable properties such as caking, humidity sensitivity, poor process control and variations in triboelectric charge with usage. Additionally, not all fusing techniques are the same. In the radiant fusing technique, particular difficulties arise because there is no direct contact for the transfer of heat to the copy as in the use of heated or pressure fusing rollers.

It has been found that the above mentioned difficulties encountered in the radiant fusing technique can be overcome by choosing a resin that will yield a toner with the right triboelectric properties and fusing characteristics. The resin should have a melting point of 75°–100°C, a melt index of 20–30, a dielectric constant of 4–5 and a good tendency to wet and penetrate paper. The resin should also be compatible with the normally used coloring agents.

The melt index, as used herein, is understood to be a measure of how many grams of the development powder will flow in 10 minutes at a temperature of 150°C, which measurement is in accordance with ASTM 1238. The values for dielectric constant, conductance and dissipation factor included herein were measured in accordance with ASTM D-150-70. The melting points were measured using a Fisher Johns melting apparatus.

SUMMARY OF THE INVENTION

It has been found that the use of particular resins based on acrylics and combined with vinyl toluene-butadiene copolymer will yield a high quality developer powder when used as a binder as the properties of the resins have been found to compliment one another. Such combinations include copolymer resins comprising styrene and an acrylate or methacrylate, each of the latter two selected from the group of butyl, isobutyl, ethyl, propyl and isopropyl and combining the same with vinyltoluene-butadiene copolymer. This combination may vary from 40–90% styrene-acrylate or styrene-methacrylate to 10–60% vinyltoluene-butadiene. The resulting developer powder has a melting point in the range of 75°–100°C, a melt index of 20–30 and a dielectric constant of 4–5.

BRIEF DESCRIPTION OF THE PREFERRED EMBODIMENT

In examining various resins for use as developer powders in a copier using a radiant heating fuser, it was found that virtually all commercially available resins have drawbacks when used individually as a developer powder. For example, styrene-butylmethacrylate copolymer when used in a developer powder was found to yield a powder that was too hard and with a low melt index. This hardness resulted in a solid toner which was brittle and difficult to process. Additionally, difficulty in fusing the toner was experienced when using a radiant fuser. High fusing temperatures were required which had an adverse affect upon the copy paper. Although good copies were made using an electroscopic solid toner based on styrene-butylmethacrylate, the parameters associated with obtaining these good copies rendered the styrene-butylmethacrylate copolymer an unattractive resin for use in a developer powder.

Softer resins were also tried in development powders including a styrene-acrylate copolymer. The problem found with this type of resin was that its use did not produce good copies because of trailing and the electrical properties were not acceptable.

A combination of resins including styrene-butylmethacrylate and polystyrene-acrylate were tested, but, again, good results were not achieved. Although the fusing properties were better than those achieved with a hard resin, they proved still difficult to fuse using a radiant fuser and the properties were deficient in that they showed trailing characteristics. Another resin which was investigated was vinyltoluene-butadiene, but this copolymer when used as the binder in a solid toner resulted in poor copy quality.

A further combination of copolymeric resins which was investigated was a styrene-butylmethacrylate and vinyltoluene-butadiene in proportions of 9 parts styrene-butylmethacrylate to 1 parts vinyltoluene-butadiene. Although the properties improved somewhat, the combination was still not acceptable because the amount of fusing was not adequate. It was decided to vary the ratio of these two copolymeric resins to determine whether this combination could result in an acceptable binder for developer powder if used in proper proportions. This was indeed found to be the case. When the amount of styrene-butylmethacrylate is in the range of 40–90% and the vinyltoluene-butadiene is in the range of 10–60%, a high quality binder for a development powder results.

Another combination of copolymers which was used with good results was styrene acrylate: vinyltoluene-butadiene in ratios of 40–90% and 10–60% respectively. Again, with the proper ratios, a high quality resinous binder for a development powder results.

Various other combinations were tried and it was determined that in the styrene copolymers having either acrylic or methacrylic the group including butyl, isobutyl, propyl and isopropyl are acceptable.

A suitable pigment is added to the resins to form the solid toner preferably comprising 1–10% pigment. The particle size of the development toner should be 10–20 microns. Means for achieving the proper size is well known in the art. The following are examples of pigments which may be used in the solid toner formulation of this invention Sterling R carbon black, Mogul L carbon black, Carbolac 2 carbon black, (Cabot Corp. Boston, Mass.); Pyramid green pigment 3Y, (Max Marx Color and Chemical Co., Irvington, N.J.); Diarylide yellow pigment, Alkali blue R, Graphic red M, (Sherwin Williams Chemicals, Chicago, Ill.); Methyl violet, (Chemetron Corp. Holland, Mich.); and Sodium Lithol (Hilton Davis Chemical Co., Cincinnati, Ohio). Optionally, up to 8% dye may be added to the toner to tint the image. Dyes used for this purpose are well known in the art, i.e., nigrosine, alkali blue G, alkali blue R, aniline Blue, Calco Oil Blue, Dupont Oil Red, methylene blue chloride and phthalocyanine blue.

It will be appreciated that a multiplicity of pigments and dyes may be used in a solid toner formulation, as is well known in the art, and the selection of the same to be used does not form any part of this invention.

After the solid toner is prepared by blending the resins, pigment and dye, it is added to triboelectrically chargeable carrier particles. Preferably, the development powder comprises 0.5–5% of the solid toner. The particle size of the carrier should be from 40–300 microns. Preferably the carrier particle is a ferrous material such as iron fillings. Examples of triboelectrically chargeable particles which may be used as AP-7 (Wright Industries, Brooklyn, N.Y.) and Anchor Steel 1000S (Hoeganaes Corp., Riverton, N.J.).

In all of the Examples below, the testing of the particular toner was carried out in a PBC Copier (Copier Div. Pitney-Bowes, Inc.) which utilizes a radiant heat fuser.

EXAMPLE I

A solid toner was formulated by blending the following:

| | |
|---|---|
| Styrene-butylmethacrylate copolymer | 45.5 |
| Pliolite VTL (vinyltoluene-butadiene) Goodyear Chemicals | 45.5 |
| Mogul-L (carbon black) Cabot Corp. | 6.0 |
| Nigrosine Base NB - GAF Corp. | 3.0 |

A development powder was produced by blending two parts to the toner to 98 parts of AP-7 iron particles. The resulting development powder exhibited the following properties:

| | |
|---|---|
| Melting range | 80–95°C |
| Melt index | 20 |
| No. average diameter | 12 |

Conductivity = $1.5 \times 10^{-9}$/ohm cm

Dissipation factor = 0.017

The result was a fairly hard type of toner which required fairly high temperatures (215°–250°C) and did not flow quite as well as desired. Nonetheless, the development toner was inserted into a PBC Copier and a number of copies were produced. Good results were achieved.

EXAMPLE II

The following ingredients were blended to form a solid toner:

| | |
|---|---|
| An equal part blend of styrene-butylmethacrylate and polyvinyl styrene-acrylate | 72.8 |
| Pliolite VTL | 18.2 |
| Mogul-L | 6 |
| Nigrosine NB | 3 |

This solid toner was added to Anchor Steel 1000S iron particles, the toner being 2.7% of the final development powder, with the following physical properties:

| | |
|---|---|
| Melting range | 80–95°C |
| Melt index | 26 |
| No. average diameter | 8.3 |

Conductivity = $2.87 \times 10^{-9}$/ohm cm

Dissipation factor = 0.02

This proved to be a softer type of toner which gave good results with a lower fuser operating temperature of 150°–200°C.

EXAMPLE III

| | |
|---|---|
| Goodyear Chemicals BACL (styrene-acrylate) | 71 |
| Pliolite VTL | 20 |
| Mogul-L | 6 |
| Nigrosine Base NB | 3 |

Two parts of the above were added to 98 parts AP-7 and the following properties resulted:

| | |
|---|---|
| Melting range | 70–85°C |
| No. average particle diameter | 14 |

Conductivity = $1.8 \times 10^{-9}$/ohm cm

Dissipation factor — 0.017

Results as good as Example II were achieved with about the same softness. The lower melting range of this development toner has the advantage that less power is required for the fuser.

EXAMPLE IV

| | |
|---|---|
| Polyvinyl B-1016 | 72.8 |
| Pliolite VTL | 18.2 |
| Regal 99R (Cabot Corp.) | 6.0 |
| Nigrosine Base NB | 3.0 |

Two parts of the above toner was added to 98 parts AP-7 iron particles and the following properties resulted:

| | |
|---|---|
| Melting range | 80–100°C |
| Melt index | 26 |

Conductivity = $2.3 \times 10^{-9}$/ohm cm

Dissipation factor = 0.03

The above development toner is the same as Example II except that a different carbon black was used. Essentially, the same results were achieved.

What is claimed is:

1. A solid toner for use in electrostatic printing to develop latent electrostatic images, the combination comprising:

a. a coloring agent, and b. a polymeric blend composed of 10–60% prepolymerized copolymer of vinyltoluene-butadiene and 40–90% of a prepolymerized copolymer selected from the group consisting of styrene-acrylate and styrene-methacrylate.

2. The solid toner of claim 1 wherein said coloring agent is selected from the group consisting of pigments and dyes.

3. The solid toner of claim 2 wherein said pigment is a carbon black.

4. The solid toner of claim 2 wherein the quantity of said coloring agent is 1 to 8%.

5. A solid toner for use in electrostatic printing to develop latent electrostatic images, the combination comprising:

a. a coloring agent, and b. a polymeric blend composed of 40–90% prepolymerized copolymer of styrene-methacrylates and 10–60% prepolymerized copolymer of vinyltoluene-butadiene, said methacrylate being selected from the group consisting of butyl, isobutyl, ethyl, propyl and isopropyl.

6. The solid toner of claim 5 wherein the quantity of coloring agent is 1–16% of the toner.

7. A solid toner for use in electrostatic printing to develop latent electrostatic images, the combination comprising:

a. a coloring agent, and b. a polymeric blend composed of 40–90% prepolymerized copolymer of styrene-acrylate and 10–60% prepolymerized copolymer of vinyltoluene-butadiene, said acrylate being selected from the group consisting of butyl, isobutyl, ethyl, propyl and isopropyl.

8. The solid toner of claim 7 wherein the quantity of coloring agent is 1–16% of the toner.

9. A development powder for use in electrostatic printing to develop latent electrostatic images, the combination comprising:

a. a solid triboelectrically chargeable carrier particle;

b. a coloring agent, and c. a polymeric blend composed of 10–60% prepolymerized copolymer of vinyltoluene-butadiene and 40–90% of a prepolymerized copolymer selected from the group consisting of styrene-acrylate and styrene-methacrylate.

10. The development powder of claim 1 wherein said carrier particles are iron.

11. The solid toner of claim 1 wherein said coloring agent is selected from the group consisting of pigments and dyes.

12. The solid toner of claim 2 wherein said pigment is a carbon black.

13. A development powder for use in electrostatic printing to develop latent electrostatic images, the combination comprising:

a. a solid triboelectrically chargeable carrier particle; and b. a solid toner comprising:

1. a coloring agent, and 2. a polymeric blend composed of 40–90% prepolymerized copolymer of styrene-methacrylate and 10–60% prepolymerized copolymer of vinyltoluene-butadiene, said methacrylate being selected from the group consisting of butyl, isobutyl, ethyl, propyl and isopropyl.

14. The development powder of claim 13 wherein the quantity of said solid toner is 0.5 to 5% of the powder.

15. The development powder of claim 14 wherein said coloring agent comprises 1–16% of said solid toner.

16. A development powder for use in electrostatic printing to develop latent electrostatic images, the combination comprising:

a. a solid triboelectrically chargeable carrier particle;

b. a solid toner comprising:

1. a coloring agent, and 2. a polymeric blend composed of 40–90% prepolymerized copolymer of styrene-acrylate and 10–60% prepolymerized copolymer of vinyltoluene-butadiene, said acrylate being selected from the group consisting of butyl, isobutyl, ethyl, propyl and isopropyl.

17. The development of claim 16 wherein the quantity of said solid toner is 0.5 to 5% of the powder.

18. The development powder of claim 17 wherein said coloring agent comprises 1–16% of said solid toner.

* * * * *

UNITED STATES PATENT OFFICE

CERTIFICATE OF CORRECTION

Patent No. 3,980,576 Dated September 14, 1976

Inventor(s) Bheema Rao Vijayendran

It is certified that error appears in the above-identified patent and that said Letters Patent are hereby corrected as shown below:

Column 3, Example I, second block, line 54, after "12" insert --$\mu$--.

Column 4, Example II, second block, line 18, after "8.3" insert --$\mu$--;

Example III, second block, line 41, after "14" insert --$\mu$--.

Signed and Sealed this sixteenth Day of August 1977

[SEAL]

Attest:

RUTH C. MASON
*Attesting Officer*

C. MARSHALL DANN
*Commissioner of Patents and Trademarks*